US007161125B2

(12) United States Patent
Yoshidome et al.

(10) Patent No.: US 7,161,125 B2
(45) Date of Patent: Jan. 9, 2007

(54) COOKING APPLIANCE

(75) Inventors: Akihiro Yoshidome, Osaka (JP); Mitsuo Hirooka, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 11/028,847

(22) Filed: Jan. 4, 2005

(65) Prior Publication Data

US 2005/0173399 A1 Aug. 11, 2005

(30) Foreign Application Priority Data

Jan. 8, 2004 (JP) ..... 2004-002830
Jan. 14, 2004 (JP) ..... 2004-007384

(51) Int. Cl.
*H05B 6/76* (2006.01)

(52) U.S. Cl. ..... 219/756; 219/757

(58) Field of Classification Search ..... 219/756, 219/757, 754, 752, 749, 739, 763, 714, 400, 219/392, 385, 394; 126/340, 339, 237 A, 126/19 M, 19 R; 312/336; 211/193
See application file for complete search history.

(56) References Cited

U.S. PATENT DOCUMENTS 4,335,292 A * 6/1982 Tanaka et al. ..... 219/754
4,814,571 A * 3/1989 Bowen et al. ..... 219/757
6,166,353 A * 12/2000 Senneville et al. ..... 219/385

FOREIGN PATENT DOCUMENTS

| | | |
|---|---|---|
| JP | 03-045820 | 2/1991 |
| JP | 06-109257 | 4/1994 |
| JP | 11-237053 | 8/1999 |

* cited by examiner

*Primary Examiner*—Quang Van
(74) *Attorney, Agent, or Firm*—Renner, Otto, Boisselle & Sklar, LLP

(57) ABSTRACT

A cooking appliance has a configuration that allows the heating item mounting unit of a heating chamber to be pulled out, and that can prevent generation of discharge failure by microwaves, without having to form a slide mechanism with a component or material that has high heat-resistance and fire-resistance. The cooking appliance includes a main unit with a heating chamber, a drawer unit arranged movable in the main unit so as to be pulled out from the heating chamber of the main unit, and a slide rail for moving the drawer unit in the main unit. The slide rail is provided outside the heating chamber.

9 Claims, 8 Drawing Sheets

COOKING APPLIANCE

This nonprovisional application is based on Japanese Patent Application Nos. 2004-002830 and 2004-007384 filed with the Japan Patent Office on Jan. 8, 2004 and Jan. 14, 2004, respectively, the entire contents of which are hereby incorporated by reference.

BACKGROUND OF THE INVENTION

1. Field of the Invention

The present invention generally relates to a cooking appliance, and more particularly, to a cooking appliance with a drawer in which an item to be heated is placed, wherein the drawer can be withdrawn from the main unit of the cooking appliance.

2. Description of the Background Art

Such a conventional drawer-type cooking appliance employing a configuration that allows the heating item mounting unit of a heating chamber to be pulled out is proposed in, for example, Japanese Patent Laying-Open Nos. 03-045820, 06-109257, and 11-237053.

The door closure device of the cooking appliance disclosed in Japanese Patent Laying-Open No. 03-045820 includes a main unit with a cooking chamber in which an item to be heated is placed, a door shielding the cooking chamber from the atmosphere, a bottom panel in cooperation with the door, and a slide mechanism for sliding the bottom panel smoothly. FIG. 11 is a schematic side sectional view of the door closure device of the conventional cooking appliance disclosed therein.

As shown in FIG. 11, a main unit 1 includes a heating chamber 3, The closure device is adapted to pull out/push in a drawer unit 2 including a door 4 and a bottom panel 16 from/into a heating chamber 3 by means of a slide mechanism. An item to be heated 6 is placed on bottom panel 16. The slide mechanism is adapted such that rollers 17 and 18 fixed in heating chamber 3 of main unit 1 sandwich a bent of bottom panel 16.

Japanese Patent Laying-Open No. 06-109257 discloses a cooking appliance with a drawer in which an item to be heated is placed, wherein the drawer can be withdrawn from the main unit of the cooking appliance. By virtue of detection means for detecting pull-out of the drawer, upset of the cooking appliance is obviated to allow a drawer-type cooking appliance to be used in always a stable state.

Japanese Patent Laying-Open No. 11-237053 discloses a microwave oven adapted to prevent leakage of electromagnetic waves even if the food item mounting unit is configured in a movable drawer structure. FIG. 12 is a schematic side sectional view of the conventional microwave oven disclosed therein.

Referring to FIG. 12, a heating receptacle 5 having an opening at the top is provided so as to be withdrawn arbitrarily from a main unit 1. An item to be heated 6 is placed in heating receptacle 5. A lid 19 covering the opening of heating receptacle 5, heating receptacle 5 and provided at the main unit side 1 constitute a heating chamber 3 that shuts microwaves. By providing a choke groove 20 between the circumference portion of heating chamber 5 and lid 19 corresponding to this circumference portion of heating chamber 5, leakage of microwaves can be prevented.

In accordance with the door closure device of the cooking appliance disclosed in Japanese Patent Laying-Open No. 03-045820, bottom panel 16 can slide within heating chamber 3 by being sandwiched between the two rollers 17 and 18 fixed within heating chamber 3 of main unit 1. Since the slide mechanism is provided inside the heating chamber, the components constituting the slide mechanism will be heated to a high temperature corresponding to the interior of the heating chamber attaining a high temperature during the heating process of the item to be heated. Accordingly, the slide mechanism must be formed by costly components and/or material that is highly heat-resistant and fire-resistant, leading to the problem of increase in the fabrication cost. Furthermore, provision of the slide mechanism in the heating chamber constitutes a factor for causing discharge by microwaves.

It is to be noted that Japanese Patent Laying-Open Nos. 06-109257 and 11-237053 are silent about a slide mechanism to smoothly withdraw a drawer unit from the main unit, a configuration of such a mechanism, and the site of arrangement thereof.

SUMMARY OF THE INVENTION

In view of the foregoing, an object of the present invention is to provide a cooking appliance of a configuration that allows the heating item mounting unit of a heating chamber to be pulled out, and that can prevent occurrence of discharge by microwaves, without having to form a slide mechanism with a component or material that has high heat-resistance and fire-resistance.

According to an aspect of the present invention, a cooking appliance includes a main unit with a heating chamber, a drawer unit arranged to move in the main unit so as to be pulled outside the heating chamber of the main unit, and a transfer mechanism to transfer the drawer unit in the main unit. The transfer mechanism is provided outside the heating chamber.

Since the transfer mechanism is provided outside the heating chamber in the cooking appliance of the present invention, it is not necessary to employ costly components and/or material that has high heat-resistance and fire-resistance to form the transfer mechanism. Therefore, the fabrication cost can be reduced.

Furthermore, the transfer mechanism is not affected by the microwaves emitted in the heating chamber. Therefore, there is no possibility of discharge by microwaves.

In the cooking appliance of the present invention, the drawer unit includes a door, and a heating receptacle in which an item to be heated is held. The door of the drawer unit is preferably supported on the main unit outside the heating chamber by the transfer mechanism. In this case, the drawer will not tip forward when pulled out from the heating chamber of the main unit since the drawer unit is supported on the main unit by the transfer mechanism. Thus, the drawer unit can be pulled out in a stable manner.

In the cooking appliance of the present invention, the door of the drawer unit is preferably supported on the main unit by the left and right sidewalls and the bottom wall outside the heating chamber via the transfer mechanism. Since the drawer unit is supported on the main unit by at least 3 sites, a configuration that allows the drawer unit to be withdrawn smoothly and stably can be realized.

In the cooking appliance of the present invention, the transfer mechanism preferably includes a fixed rail attached to the main unit, and a movable rail attached to the door of the drawer unit.

In the cooking appliance of the present invention, the drawer unit includes a door, and a heating receptacle in which an item to be heated is held. The inner side of the bottom of the heating receptacle preferably has a concave. By such a configuration, the liquid of the heating item that splashes out, when spilt out through the pulling in/pulling out movement of the drawer unit or during the heating process, will remain within the concave at the inner side of the bottom of the heating receptacle. Such liquid will not fall on the platform or floor where the main unit is installed when the drawer unit is pulled out. Therefore, the area around the cooking appliance can be kept clean.

In accordance with the cooking appliance of the present invention, the drawer unit includes a door, a heating receptacle in which an item to be heated is held, and a mounting arranged in the heating receptacle, and on which an item to be heated is placed. It is preferable that the mounting can be removed from the heating receptacle. Such a configuration allows ease of cleaning. Since the liquid from the heating item that splashes out, when spilt out through the pulling in/pulling out movement of the drawer unit or during the heating process, will remain within the mounting, only the mounting has to be removed from the drawer unit to be wiped off or directly washed for cleaning. In this case, the inner side of the bottom of the heating receptacle has a concave, and the mounting preferably has a configuration that fits the concave of the inner side of the bottom of the heating receptacle.

In the cooking appliance of the present invention, the rear wall of the heating receptacle is preferably set lower than the height of the left and right walls. Such a configuration allows ease of cleaning. Even in the case where liquid splashed out from the item to be heated adheres to the ceiling of the heating chamber, the ceiling of the heating chamber can be easily wiped with the drawer unit in a pulled-out state. Thus, a cooking appliance that can easily be cleaned is provided.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Embodiments of the present invention will be described hereinafter with reference to the drawings.

Figure 1:
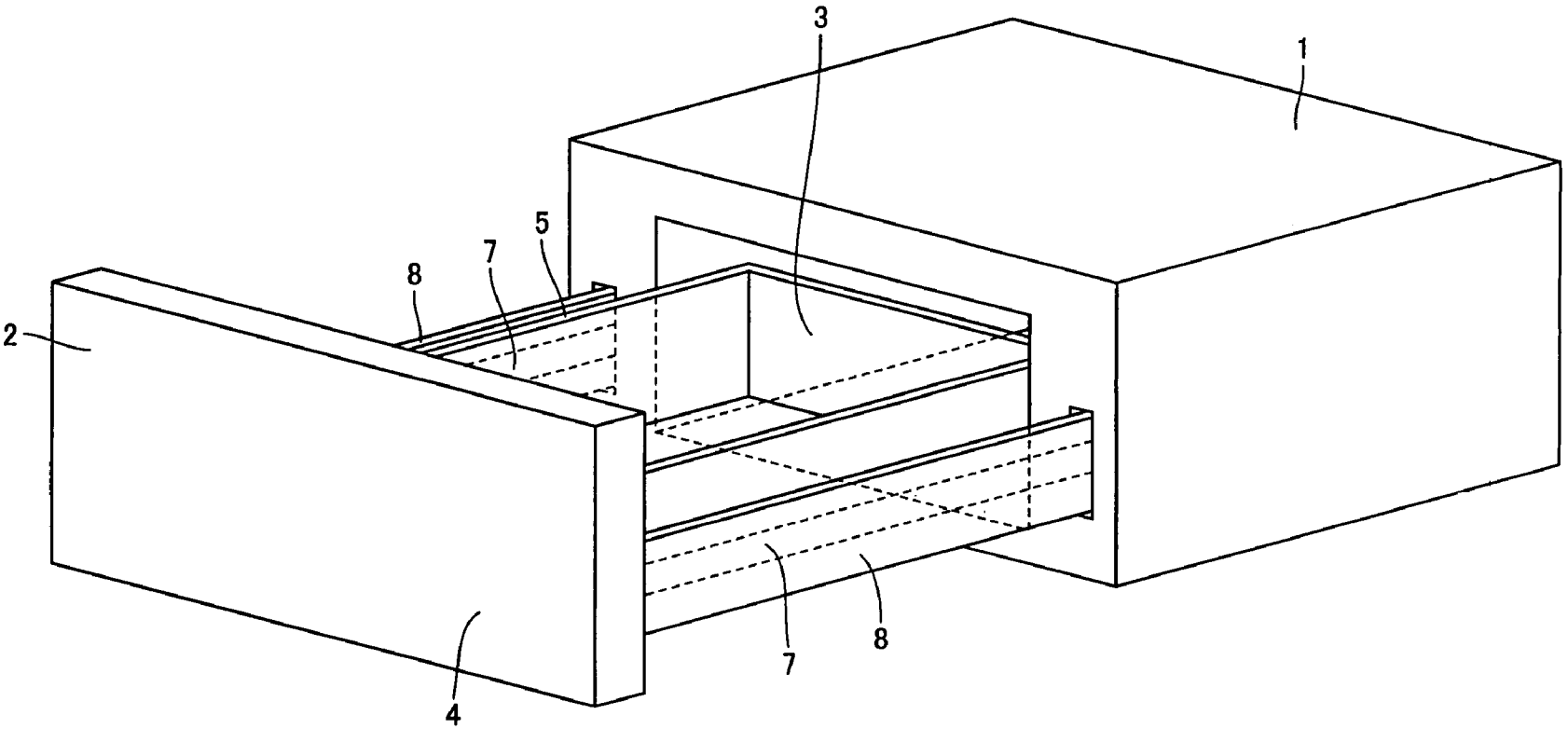
FIG. 1 is a schematic perspective view of an appearance of a cooking appliance according to a first embodiment of the present invention.
Figure 2:
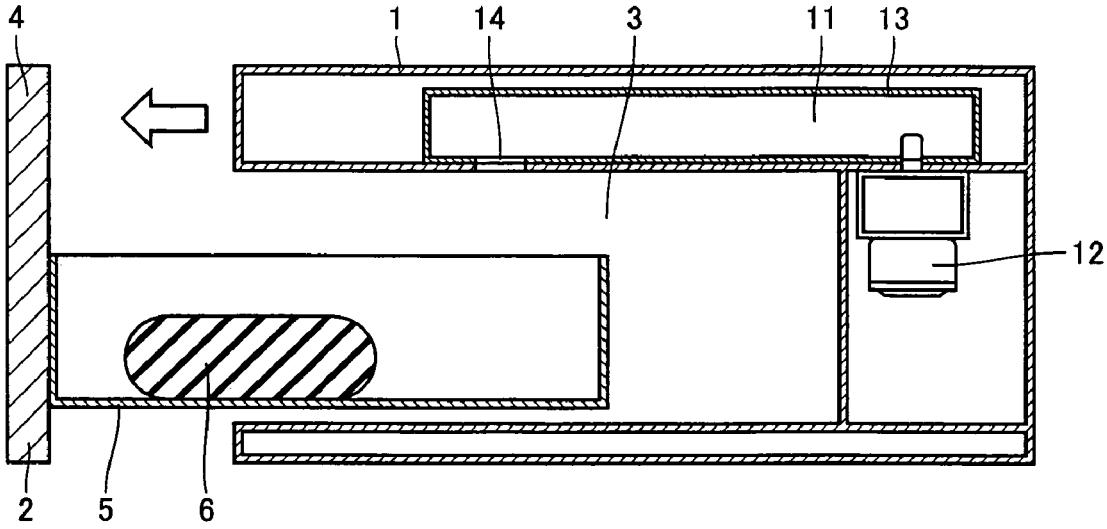
FIG. 2 is a side sectional view of the cooking appliance of the first embodiment of the present invention in a direction parallel to the pulling out direction of the drawer unit.
Figure 3:
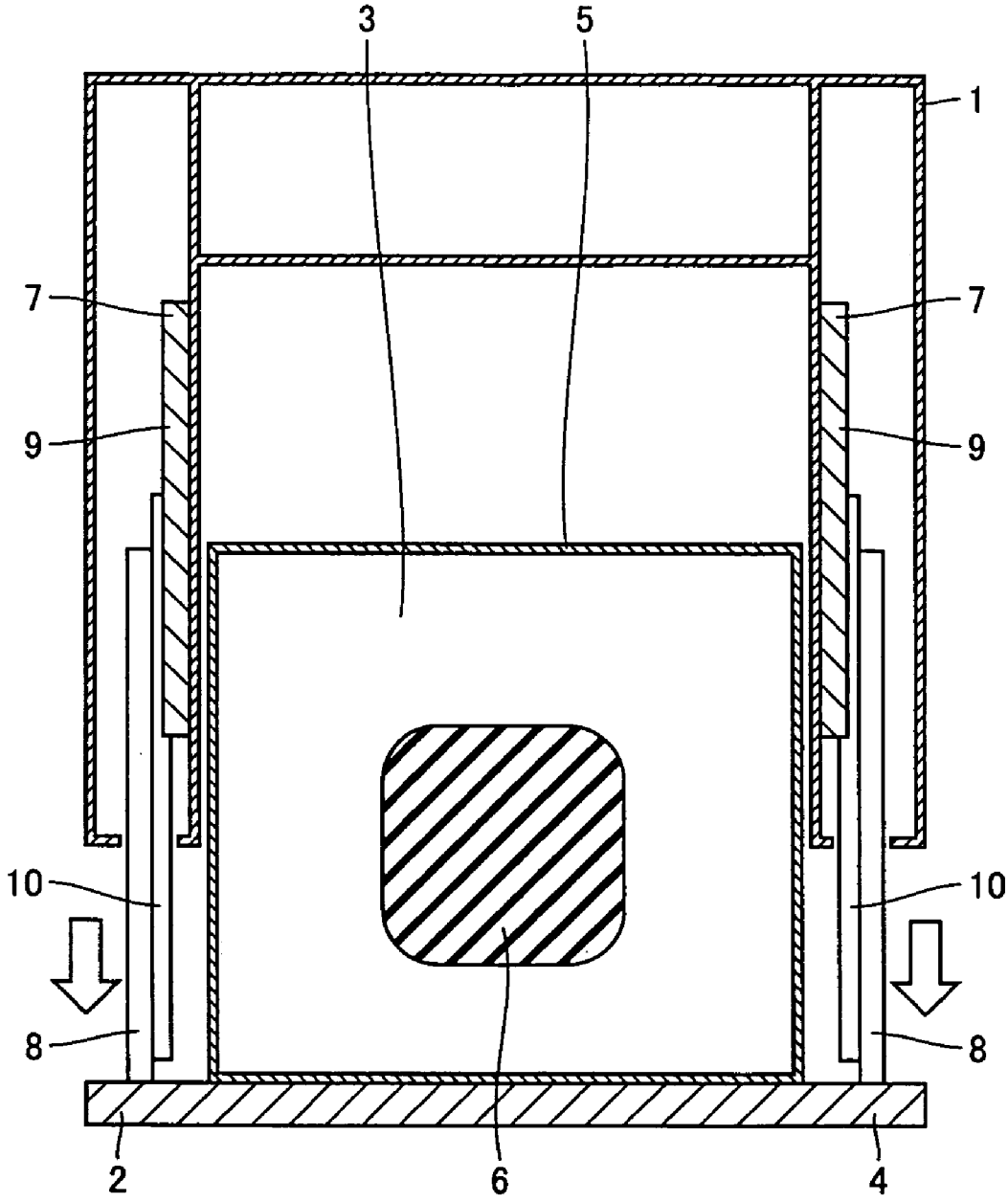
FIG. 3 is a plan sectional view of the cooking appliance of the first embodiment of the present invention in a direction parallel to the pulling out direction of the drawer unit.

Referring to FIGS. 1, 2 and 3, a main unit 1 of a cooking appliance according to a first embodiment of the present invention includes a heating chamber 3 to cook an item to be heated 6. A drawer unit 2 is arranged in a movable manner, i.e. slidable manner, in main unit 1 so as to be withdrawn from heating chamber 3 of main unit 1 in the direction indicated by the arrow. The cooking appliance includes a slide rail 7 identified as the transfer mechanism to slide drawer unit 2 in main unit 1. Drawer unit 2 includes a door 4 to open/close heating chamber 3, and a heating receptacle 5 in which item 6 is placed and held. Heating receptacle 5 includes sidewalls at the left and right sides, a rear wall at the back in heating chamber 3 of main unit 1, and an opening at the top. Door 4 is attached at the front of heating receptacle 5. By closing heating chamber 3 through door 4, the interior cavity of heating chamber 3 corresponds to a sealed cavity by the inner walls of main unit 1 and drawer unit 2.

Door 4 of drawer unit 2 is supported on main unit 1 by the left and right sidewall surfaces outside heating chamber 3 via slide rail 7. Slide rail 7 includes a fixed rail 9, and a movable rail 10 sliding along fixed rail 9. Fixed rail 9 is attached at the left and right sidewall surfaces outside heating chamber 3 of main unit 1. Movable rail 10 is attached to door 4 via an L-shape angle member 8 attached at the inner sidewall surface of door 4 so as to extend from the inner sidewall surface of door 4 of drawer unit 2 towards heating chamber 3 of main unit 1.

A microwave generator 11 is arranged above and at the rear side of heating chamber 3 in main unit 1. Microwave generator 11 includes a magnetron 12 arranged outside and behind heating chamber 3 for generating a microwave, and a waveguide 13 arranged above and outside heating chamber 3 for propagation of microwaves generated from magnetron 12. The microwave generated at magnetron 12 is propagated through waveguide 13 to be supplied into heating chamber 3 via a feeding port 14 to heat item 6 placed in heating receptacle 5 of drawer unit 2 arranged in heating chamber 3 to perform cooking.

In accordance with the first embodiment of the present invention, slide rail 7 formed of fixed rail 9 and movable rail 10 identified as the transfer mechanism is provided at the left and right sidewall surfaces outside heating chamber 3. Specifically, slide rail 7 is disposed outside heating chamber 3 in a slidable manner in a channel provided at the left and right sides of heating chamber 3 in main unit 1. This channel may be a cavity enclosed by the top wall, bottom wall, and sidewalls in main unit 1. In the first embodiment of the present invention, fixed rail 9 is attached to an inner wall surface of main unit 1, outside and located closer to heating chamber 3.

Since slide rail 7 is provided outside heating chamber 3, as a transfer mechanism for moving drawer unit 2 in main unit 1, L-shape angle member 8, fixed rail 9 and movable rail 10 constituting slide rail 7 do not have to be formed of a costly component or material having high heat-resistance and fire-resistance. Therefore, the fabrication cost can be reduced.

Since slide rail 7 identified as the transfer mechanism is provided outside heating chamber 3, slide rail 7 will not be affected by the microwaves emitted to heating in chamber 3. Therefore, there is no possibility of discharge by microwaves.

Furthermore, since drawer unit 2 is supported on main unit 1 by slide rail 7, drawer unit 2 will not be tipped frontward when pulled out from heating chamber 3 of main unit 1. Drawer unit 2 can be pulled out in a stable manner.

Figure 4:
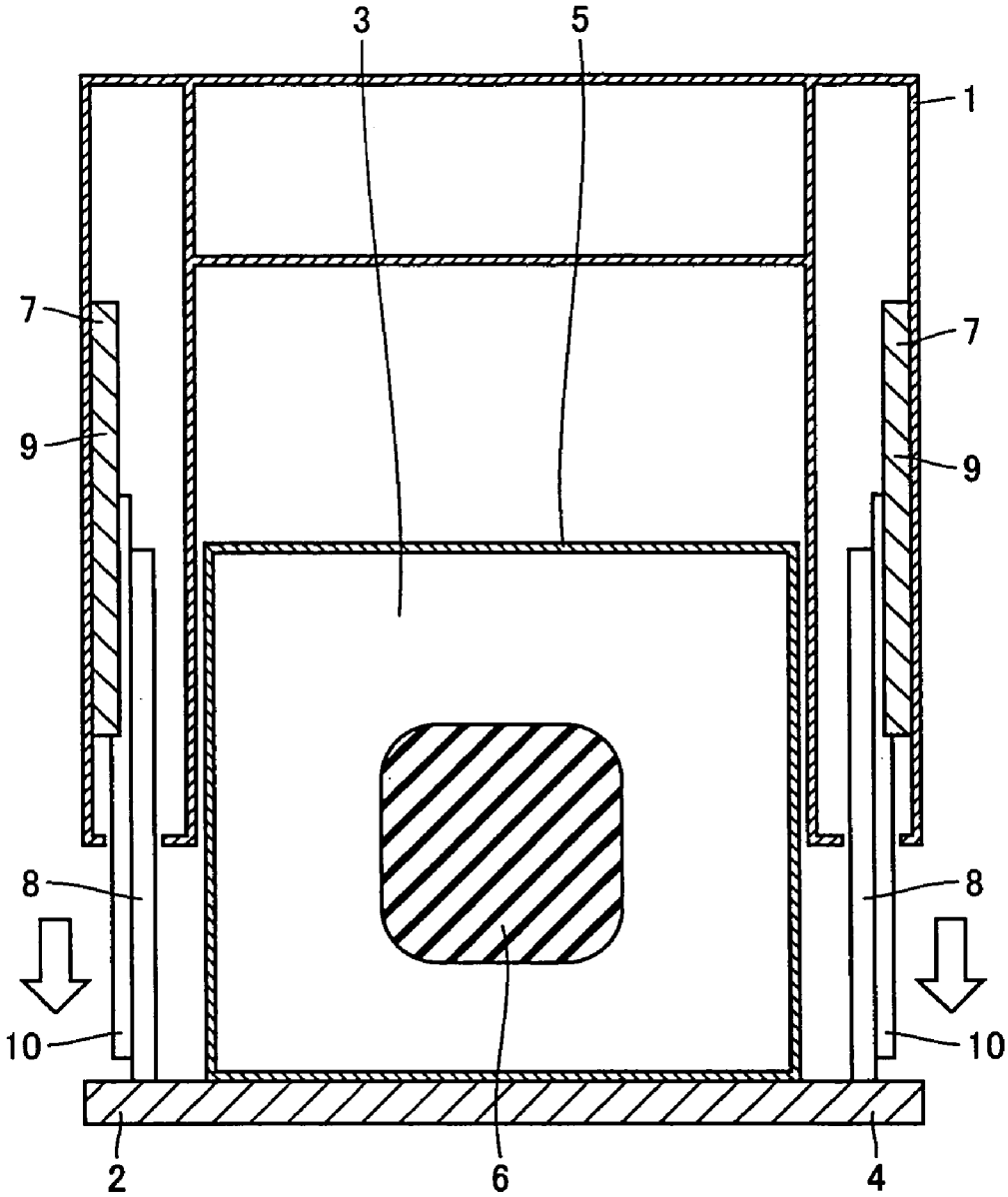
FIG. 4 is a plan sectional view of a cooking appliance according to a second embodiment of the present invention in a direction parallel to the pulling direction of the drawer unit.

FIG. 4 is a plan sectional view of a cooking appliance according to a second embodiment of the present invention in a direction parallel to the pulling out direction of the drawer unit.

In comparison with the first embodiment in which fixed rail 9 is attached to the inner wall surface of main unit 1 outside and closer to heating chamber 3, fixed rail 9 can be attached to an inner wall surface constituting the contour wall of main unit 1 outside and distant from heating chamber 3 as in the second embodiment shown in FIG. 4. The advantages similar to those of the first embodiment can be attained for the second embodiment.

Figure 5:
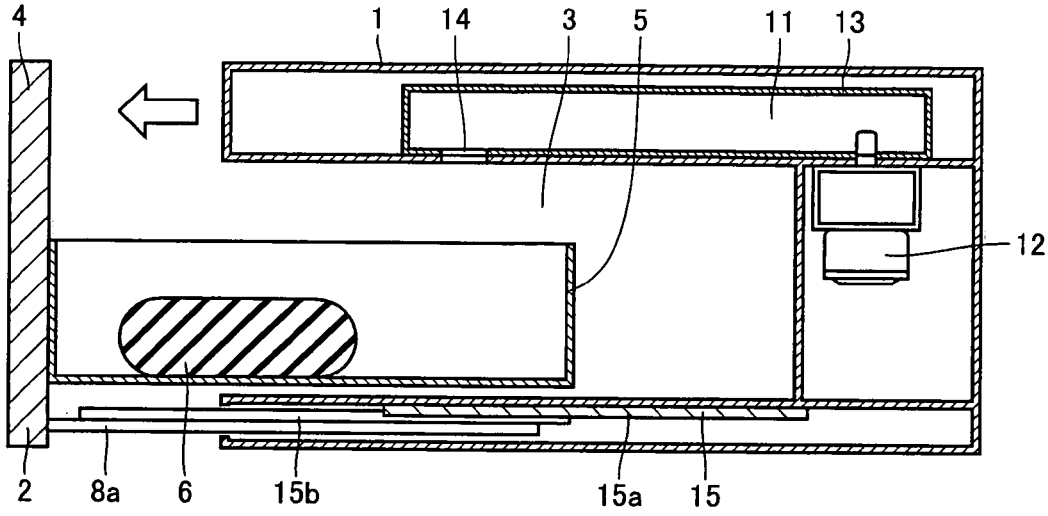
FIGS. 5, 6 and 7 are side sectional views of a cooking appliance according to a third embodiment, a fourth embodiment, and a fifth embodiment, respectively, of the present invention in a direction parallel to the pulling out direction of the drawer unit.

A cooking appliance according to a third embodiment of the present invention is shown in FIG. 5.

In addition to slide rail 7 provided at the left and right sidewalls surfaces outside heating chamber 3 as a transfer mechanism, door 4 of drawer unit 2 is supported on main unit 1 by the bottom wall surfaces outside heating chamber 3 via a slide rail 15. Slide rail 15 includes a fixed rail 15*a* and a movable rail 15*b* sliding along fixed rail 15*a*. Fixed rail 15*a* is attached to the bottom wall surfaces outside heating chamber 3 of main unit 1. Movable rail 15*b* is attached to door 4 via an L-shaped angle member 8*a* attached to the inner sidewall surface of door 4 so as to extend from the inner sidewall surface of door 4 of drawer unit 2 towards heating chamber 3 of main unit 1.

The third embodiment is characterized in that, as the transfer mechanism, slide rail 15 formed of fixed rail 15*a* and movable rail 15*b* is attached to the bottom wall surface outside heating chamber 3, in addition to slide rail 7 formed of fixed rail 9 and movable rail 10 provided at the left and right sidewall surfaces outside heating chamber 3. In other words, slide rail 15 is located outside heating chamber 3 in a slidable manner within a channel provided at the bottom of heating chamber 3 in main unit 1. This channel may be a cavity enclosed by the top wall, bottom wall and sidewalls in main unit 1. In the third embodiment of the present invention, fixed rail 15*a* is attached to the outside bottom wall surface outside heating chamber 3 of main unit 1 located closer to heating chamber 3.

Since drawer unit 2 is supported on main unit 1 by at least three sites, i.e., the left and right sidewall surfaces and the bottom wall surfaces outside heating chamber 3, the problem of drawer 2 rattling shakedly with respect to main unit 1, when pulled out from main unit 1, can be obviated. A configuration that allows drawer unit 2 to be pulled out smoothly and stably can be realized.

Although a slide rail is employed in the above-described embodiments as the transfer mechanism, a rotator such as a roller, wheel and the like, or rolling elements such as a cam follower, roller bearing, and the like can be employed.

Figure 6:
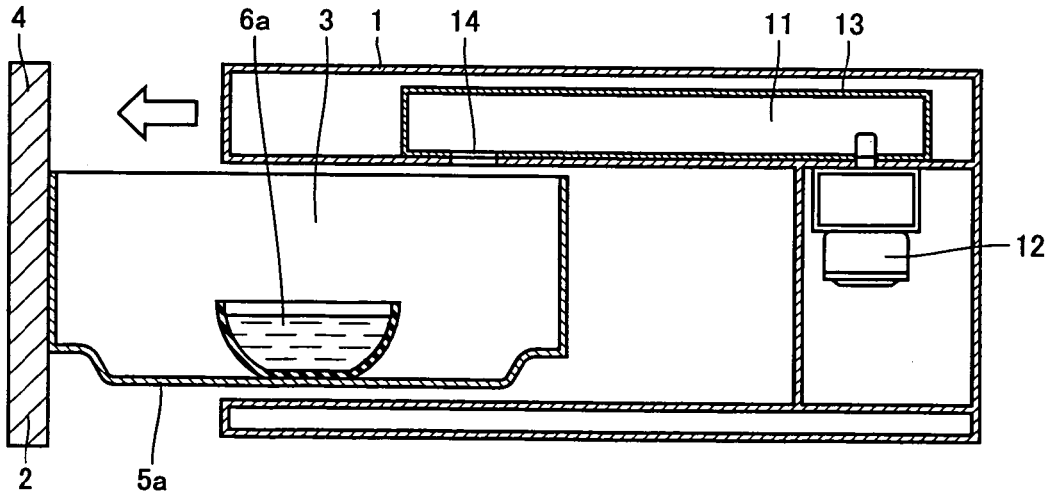

A cooking appliance according to a fourth embodiment of the present invention is shown in FIG. 6.

Referring to FIG. 6, a concave is formed at an inner side of the bottom of a heating receptacle 5*a* of drawer unit 2. An item to be heated 6*a* such as soup or sauce in a vessel is placed on the surface of this concave. The concave at the inner side of the bottom of heating receptacle 5*a* is formed as a convex at the outer side of the bottom of heating receptacle 5*a*. It is preferable that a concave is formed so as to be located at substantially the center of the inner bottom surface of heating receptacle 5*a*. Specifically, the bottom of heating receptacle 5*a* is preferably formed such that the depth of the circumferential region becomes smaller in seeing inside, and the circumferential portion is concave in an annular manner, and the center portion protrudes in seeing outside. In the case where item 6*a* to be heated is liquid such as soup or sauce, the liquid of item 6*a* may be spilt out through the pulling in/pulling out movement of the drawer due to the inertia force or may be spilt out during the heating process. By forming a concave at the inner side of the bottom of heating receptacle 5*a* in the fourth embodiment, the spilt liquid will remain within the concave in heating receptacle 5*a*, and will not fall on the floor or platform where main unit 1 is placed when drawer unit 2 is pulled out. Therefore, the area around the cooking appliance can be kept clean.

Figure 7:
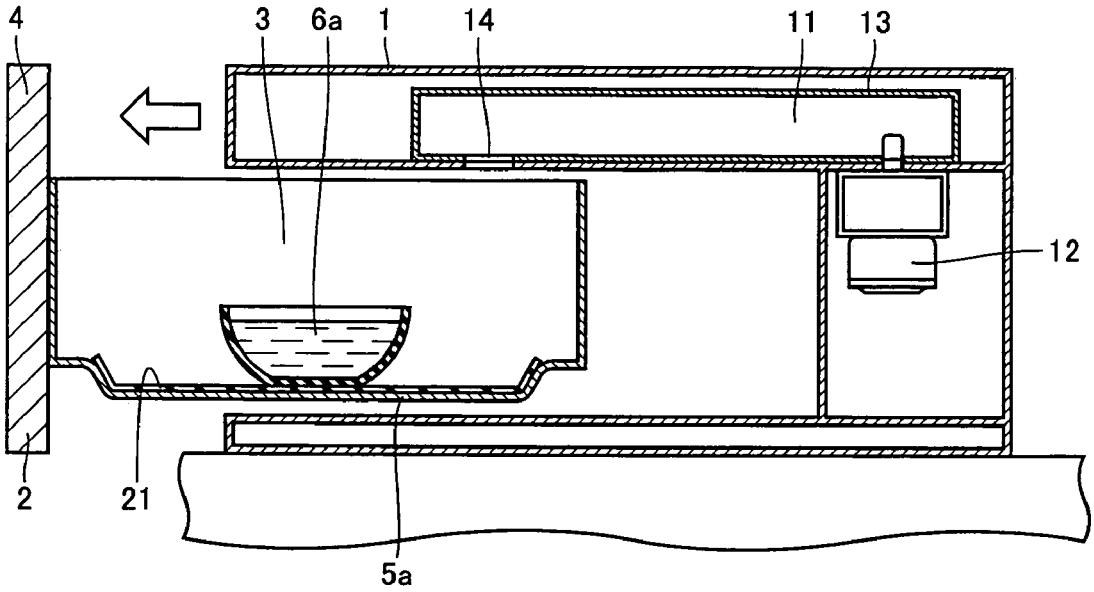

FIG. 7 is side sectional view of a cooking appliance according to a fifth embodiment of the present invention in a direction parallel to the pulling out direction of the drawer unit.

Referring to FIG. 7, a cooking appliance according to the fifth embodiment of the present invention includes a tray 21 as the mounting on which item 6*a* to be heated is placed. Tray 21 has a configuration fitting the concave portion of the inner side of the bottom of heating receptacle 5*a*, and can be removed from heating receptacle 5*a*. By virtue of such a configuration, the liquid of item 6*a* to be heated, when spilt out through the pulling in/pulling out movement of the drawer or spilt out during the heating process, will remain on tray 21. Likewise the previous fourth embodiment, the liquid will not fall on the platform or floor on which main unit 1 is installed when drawer unit 2 is pulled out. Therefore, the area around the cooking appliance can be kept clean. Furthermore, the spilt liquid will remain adhering to tray 21 that is removable from heating chamber 5*a*. Therefore, tray 21 alone can be removed from drawer unit 2 to be wiped off, or tray 21 can be directly washed with water. Thus, a cooking appliance that can be easily cleaned is provided.

Figure 8:
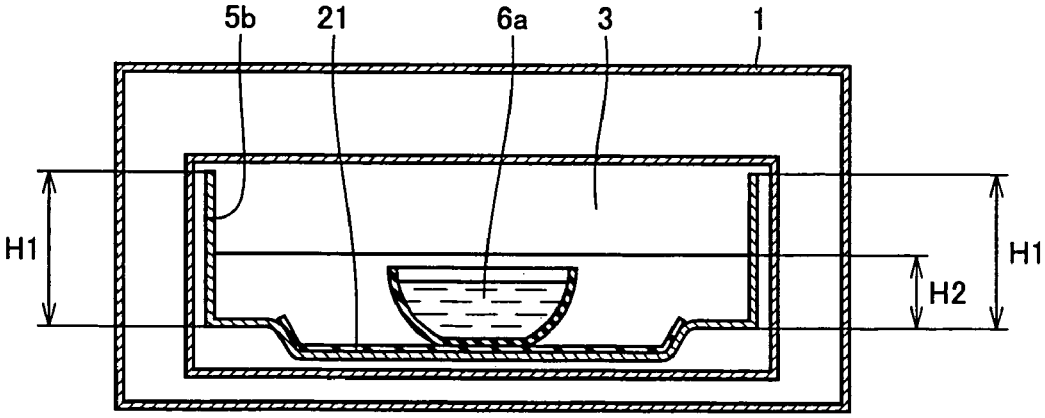
FIGS. 8 and 9 are front sectional views of a cooking appliance according to a sixth embodiment and a seventh embodiment, respectively, of the present invention in a direction perpendicular to the pulling out direction of the drawer unit.
Figure 9:
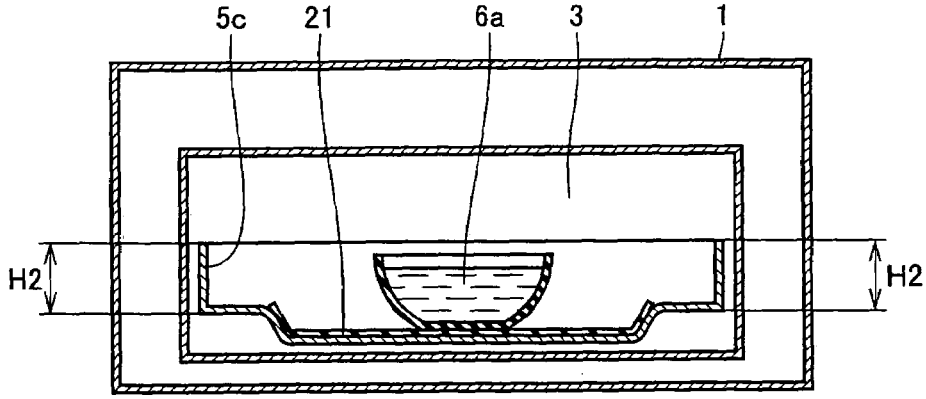
Figure 10:
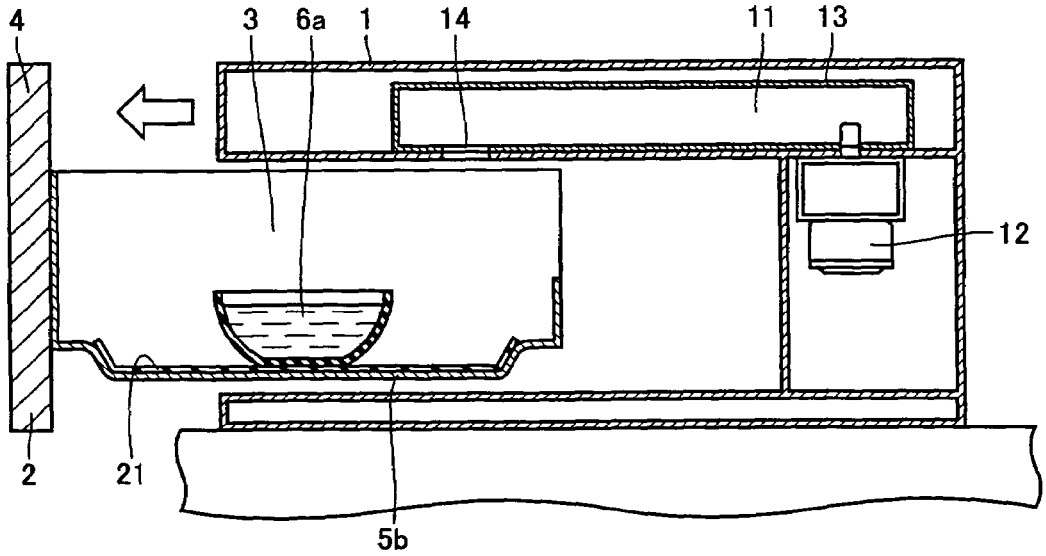
FIG. 10 is a side sectional view of the cooking appliance of the sixth embodiment of the present invention in a direction parallel to the pulling out direction of the drawer unit.
Figure 11:
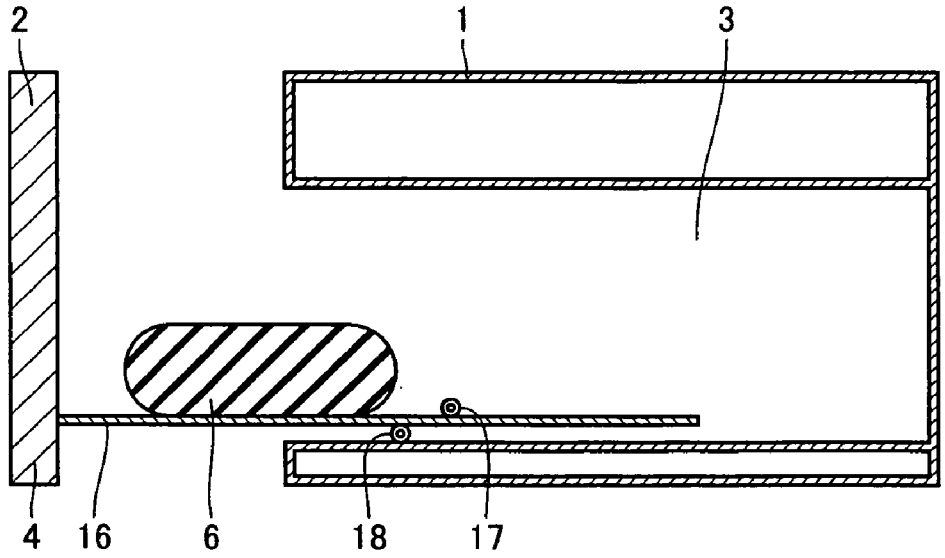
FIG.11 PRIOR ART
FIG. 11 is a schematic side sectional view of a door closure device of a conventional cooking appliance disclosed in Japanese Patent Laying-Open No. 03-045820.
Figure 12:
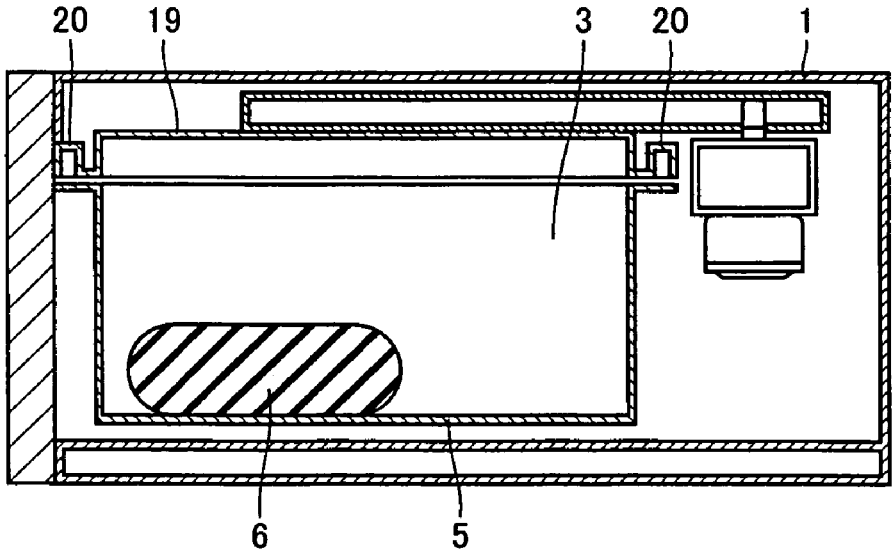
FIG.12 PRIOR ART
FIG. 12 is a schematic side sectional view of a conventional microwave oven disclosed in Japanese Patent Laying-Open No. 11-237053.

FIGS. 8 and 9 are front sectional views of a cooking appliance according to a sixth embodiment and a seventh embodiment, respectively, of the present invention, in a direction perpendicular to pulling out direction of the drawer unit. FIG. 10 is a side sectional view of the cooking appliance of the sixth embodiment of the present invention in a direction parallel to the pulling out direction of the drawer unit.

It is appreciated from FIGS. 8 and 10 that the height H2 of rear wall of heating chamber 5*b* is set lower than height H1 of the left and right sidewalls in the sixth embodiment. By setting the rear wall lower, a space to allow one's hand to be inserted to clean the interior of heating chamber 3 can be ensured between the ceiling of heating chamber 3*a* and rear wall of heating receptacle 5*b* when drawer 2 is pulled out. Therefore, even if liquid caused by splatter from item 6*a* adheres to the ceiling, it can be removed by wiping the ceiling of heating chamber 3 with drawer unit 2 pulled out. Thus, a cooking appliance that can be easily cleaned is provided. As a further modification of the sixth embodiment, the cooking appliance according to the seventh embodiment has left and right sidewalls of heating receptacle 5*c* set as low as height H2 of the rear wall, as shown in FIG. 9. Advantages embodiment can be achieved herein.

Since the costly component and/or material with high heat-resistance and fire-resistance to form the transfer mechanism is not required, the fabrication cost can be reduced. Furthermore, the possibility of discharge caused by microwaves is eliminated since the transfer mechanism is not affected by the microwaves emitted in the heating chamber.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A cooking appliance comprising:

a main unit of the cooking appliance including a heating chamber, a drawer unit, including a box-shaped heating receptacle with an opening at the top in which an item to be heated is held, arranged in a movable manner in said main unit so as to be pulled outside the heating chamber of said main unit, and a transfer mechanism fully supporting the heating receptacle for moving said drawer unit in said main unit, wherein said transfer mechanism is formed of a material that does not have high heat-resistance and fire-resistance, said transfer mechanism is arranged only outside said heating chamber with at least a portion of said transfer mechanism arranged at a lateral side of said heating chamber, and said transfer mechanism is absent inside the heating chamber.

2. The cooking appliance according to claim 1, wherein said drawer unit comprises a door, and a heating receptacle in which an item to be heated is held, and said door of the drawer unit is supported on said main unit outside said heating chamber via said transfer mechanism.

3. The cooking appliance according to claim 1, wherein said door of the drawer unit is supported on said main unit by left and right sidewall surfaces and a bottom wall surface outside said heating chamber via said transfer mechanism.

4. The cooking appliance according to claim 1, wherein said transfer mechanism comprises a fixed rail attached to said main unit, and a movable rail sliding along said fixed rail, and attached to said door of the drawer unit.

5. The cooking appliance according to claim 1, wherein said drawer unit includes a door, and a heating receptacle in which an item to be heated is held, and an inner side of the bottom of said heating receptacle includes a concave.

6. The cooking appliance according to claim 5, wherein a rear wall of said heating receptacle is lower in height than left and right sidewalls.

7. The cooking appliance according to claim 1, wherein said drawer unit comprises a door, a heating receptacle in which an item to be heated is held, and a mounting arranged within said heating receptacle and on which an item to be heated is placed, wherein said mounting can be removed from said heating receptacle.

8. The cooking appliance according to claim 7, wherein an inner side of the bottom of said heating receptacle has a concave, and said mounting has a configuration fitting the concave at the inner side of the bottom of said heating receptacle.

9. The cooking appliance according to claim 7, wherein a rear wall of said heating receptacle is lower in height than left and right sidewalls.

* * * * *